United States Patent [19]

Rogers

[11] 4,392,792

[45] Jul. 12, 1983

[54] LINEAL MULTI-CYLINDER HYDRAULIC PUMPING UNIT FOR WELLS

[76] Inventor: George L. Rogers, P.O. Box A-1, Norwood Farms Rd., York Harbor, Me. 03911

[21] Appl. No.: 240,859

[22] Filed: Mar. 5, 1981

[51] Int. Cl.[3] ..... F04B 47/04; F04B 47/14

[52] U.S. Cl. ..... 417/400; 60/372; 91/167 R

[58] Field of Search ..... 417/398, 399, 400; 91/167 R, 173; 60/372

[56] References Cited

U.S. PATENT DOCUMENTS

| | | | |
|---|---|---|---|
| 1,561,341 | 11/1925 | Martin . | |
| 2,245,501 | 6/1941 | Richardson . | |
| 2,530,673 | 11/1950 | Zinszer . | |
| 2,540,347 | 2/1951 | Pounds | 417/383 X |
| 2,614,536 | 10/1952 | Livers . | |
| 2,665,551 | 1/1954 | Chenault . | |
| 2,837,029 | 6/1958 | Mohnkern | 417/400 |
| 2,874,641 | 2/1959 | McCandlish et al. | 417/390 X |
| 2,969,042 | 1/1961 | Litz et al. . | |
| 3,072,146 | 1/1963 | Gizeski | 91/167 X |
| 3,540,814 | 11/1970 | Roeder . | |
| 3,582,238 | 6/1971 | Devine . | |
| 3,913,457 | 10/1975 | Hawley . | |

*Primary Examiner*—Leonard E. Smith

*Attorney, Agent, or Firm*—Fleit, Jacobson & Cohn

[57] ABSTRACT

The present invention provides a hydraulic pumping unit, which is capable of pumping oil and other fluids from the downhole of a well. The pumping unit includes a frame and multi-cylinder system which is attached to the frame in such a manner that it is gravity centered. The bottom of the multi-cylinder system can be attached to the rod system of a well, and when the multi-cylinder system is expanded and contracted, the rod system and moving portion of the downhole pump of the well will be reciprocated back and forth, to bring (pump) oil or other fluid to the surface of the earth.

Many other features and facets of the pumping unit are also disclosed.

41 Claims, 7 Drawing Figures

LINEAL MULTI-CYLINDER HYDRAULIC PUMPING UNIT FOR WELLS

FIELD OF THE INVENTION

This invention relates generally to improved pumping units, for use in oil wells, and more specifically to a hydraulic pumping unit.

As background, after drilling a successful oil well, a well casing of steel pipe is lowered into the drilled well, in order to prevent the caving in of the well and entry of unwanted material. Wet cement is pumped into the casing of the well, and a plug is placed on top of the cement. A stream ("head") of water is then force pumped behind the plug, and the plug forces the cement down into the hole, and up the outside of the casing. The plug goes to the bottom of the casing, and together with the liquid head, holds the cement outside until it hardens. After the cement hardens, the casing is perforated at the oil producing zone to allow oil to flow into the casing. Next, production tubing is lowered into the well. The tubing extends from the surface to below the fluid level in the well. Oil to be recovered will travel through the holes in the casing and up the tubing to the surface.

Oil is brought up to the surface via a variety of natural and man made forces (drives). Several different kinds of underground pressure (energy-drives) force oil out of the rock and into the casing up to that level supported by the energy drive and sometimes to the surface to create a "flowing well". For example, in water-drive fields, large amounts of water under natural pressure exist under and at the edges of oil deposits. The water pushes oil into the well and upward. In gas-cap-drive fields, a cap of natural gas exists on top of the oil deposits. The gas pushes down on the oil and forces it up the well. In wells where there is not sufficient underground pressure to force oil to the surface, it is necessary to pump the oil to the surface. Thus, for example, dissolved-gas-drive fields do not have enough pressure to force the oil upward to the surface, and most of the natural gas present is dissolved in the oil. Even wells which contain sufficient underground pressure to force oil to the surface during the initial period of operation of the well will stop flowing naturally after a period of time. After a well stops flowing, pumps are installed to lift the oil from underground. Most wells in the United States are "pumpers".

In the conventional surface drive pumping procedure, a subsurface or downhole pump is located below the fluid level in the well, usually above the producing zone. The pump is driven by a shaft, normally in the form of a string of "sucker rods" extending from the pump through the production tubing to the surface of the earth (slightly below the well annulus at the surface), with the driving mechanism being located at the surface. Thus, the reciprocating shaft extends through the entire depth of the well to the fluid level, and the oil being pumped from the producing zone is in contact with both the sucker rod, casing and tubing of the well during its (the oil) travel from the producing zone to the surface.

The surface driving mechanism which moves (reciprocates) the sucker rod and moving part of the downhole pump is commonly known as a "pumping unit". There are many known types of pumping units, with the "walking beam" ("jack" type) units, technically known as "crank balance pumping unit", being the most widely used in the field. A unit of this type operates by attaching the sucker rod to one end of the (pivotal) beam via known apparatus, a pivotal mounting or fulcrum being attached to the middle part of the beam, and a driving unit being attached to the other end of the beam. The driving unit consists of a vertically positioned, shaft driven, counterbalanced wheel crank which is attached through another member directly to the walking beam. As the wheel crank travels in a circular path, the walking beam is lifted upwardly and then downwardly, and transmits an upward and downward motion to the other end of the beam as the beam is pivoted back and forth. This results in the sucker rod and moving portion of the downhole pump being reciprocated up and down.

Systems for reciprocating the sucker rod which are based upon hydraulics have also been developed. These systems involve feeding a hydraulic fluid to a cylinder, and raising a piston within the cylinder, with the piston rod being connected indirectly to the sucker rod. The flow of the hydraulic fluid within the cylinder is used to control the reciprocating motion of the sucker rod. In certain cases, the cylinder and piston are located below ground, in the downhole, with hydraulic fluid being flowed to the cylinder from above ground, with the operation also being controlled from above ground.

When multiple pistons and multiple cylinders have been used in pumping units, the pistons have been connected together via a fixed piston rod, such that all of the pistons moved together as a unit. This was done so that the force applied could be increased, since the area of the faces of all of the pistons would contribute to the force being applied. Further, the prior art employed complex systems, when dealing with hydraulics to reciprocate the sucker rod. Representative patents for the above would be U.S. Pat. No. 2,245,501 to Richardson, U.S. Pat. No. 3,540,814 to Roeder, U.S. Pat. No. 3,582,238 to Devine, and U.S. Pat. No. 2,665,551 to Chenault. Further, a HEP system (hydraulics, electronics, pneumatics) using one lift cylinder, and a counterbalance cylinder, has been developed as an above-ground pumping unit. In other instances, hydraulic assists are utilized with a hydraulic cylinder and piston employed to aid in lifting the sucker rod end of the walking beam.

However, the prior art has not developed a hydraulic pumping unit which is simple to install and use, easy to regulate and maintain, easily transportable to any location, efficient, and easily matched to the demands of any well.

SUMMARY OF THE INVENTION

It is an object of the present invention to provide an improved hydraulic pumping unit.

It is a further object of the present invention to provide a pumping unit which is reliable, simple to use, easy to maintain, easily transported to any location, conventional as respects its installation and its pumping motion, efficient, and easily matched to the demands of many wells.

In order to attain these and other objectives (which will become apparent from the specification), the invention provides a pumping unit as follows.

A plurality of cylinders are arranged substantially in a vertical straight line, such that the piston rod of each cylinder is connected to the end of the hydraulic cylinder which is next in the straight line. The line of hydraulic cylinders can be arranged such that the piston rods extend upwardly, or such that they extend downwardly. If the piston rods extend upwardly, the topmost rod is connected to hang from a gravity centering member of a frame which suspends the entire cylinder assembly from the frame positioned and centered over the well. If the piston rods extend downwardly in the assembly, the topmost cylinder is connected to the gravity centering member, which is connected to the frame. The gravity centering connection member is fixed to and suspended from the top of the frame, such that the assembly can swing freely, centered and aligned by the force of gravity. While it is sufficient to employ only one gravity centering member which is suspended from the frame with the piston rod-cylinder connections being rigid, the preferred embodiment involves employing a gravity centering or hanging member between each cylinder and each piston rod, such that the gravity centering member is connected at one end to the piston rod extending from one cylinder, and at the other end to the next cylinder.

The cylinder assembly is connected to the sucker rods by way of the polished rod (which moves up and down through a stuffing box at the well annulus); the sucker rods, in turn, to the moving part of the downhole pump, which pump urges oil toward the surface. The feeding of hydraulic fluid to the cylinders provides movement of the cylinders, the polished rod, the sucker rod, and the moving portion of the downhole pump, such that each of these members reciprocates up and down, and such that oil is brought toward the surface through the tubing.

Although reference is made throughout the specification to oil, the present invention would obviously apply to any other fluid which can be pumped from a downhole via a reciprocating motion.

While hydraulic fluid, via the extension and contraction of the suspended cylinders, can be used to both raise and lower the sucker rod and downhole pump system, the force of gravity can also be used in lowering the sucker rod and downhole pump system, after it has been raised via the hydraulic fluid. Walking beam type pumping units store part of the gravitational energy generated on downstroke and use it on the upstroke, via counter balance weights attached via "pittman arm" to the "wheel crank". In a hydraulic pumping unit, compressed gas can be used, in order to store the energy dissipated by either the force of gravity or use of hydraulic fluid on downstroke. Even further, a partial vacuum can also be used to store energy. Therefore, another embodiment of the present invention is provided, whereby the cylinder-piston assembly of each piston can be modified, such that excess hydraulic energy and gravitational energy are stored in each stroke. This is accomplished for example by locating a plurality of energy storing pistons (or one if desired) at the side of, or attached to, each of the working pistons. As the sucker rod assembly is moved downwardly through the well, the side pistons store energy in the form of gas being compressed in one of the chambers of the side cylinders, while at the same time, a partial vacuum is being increased due to the movement of the pistons relative to the cylinders.

The accomplishments and advantages of the present invention will be more fully understood from the drawings, specifications, and description of the advantages of the present invention which follow.

DESCRIPTION OF THE PREFERRED EMBODIMENTS

Figure 1:
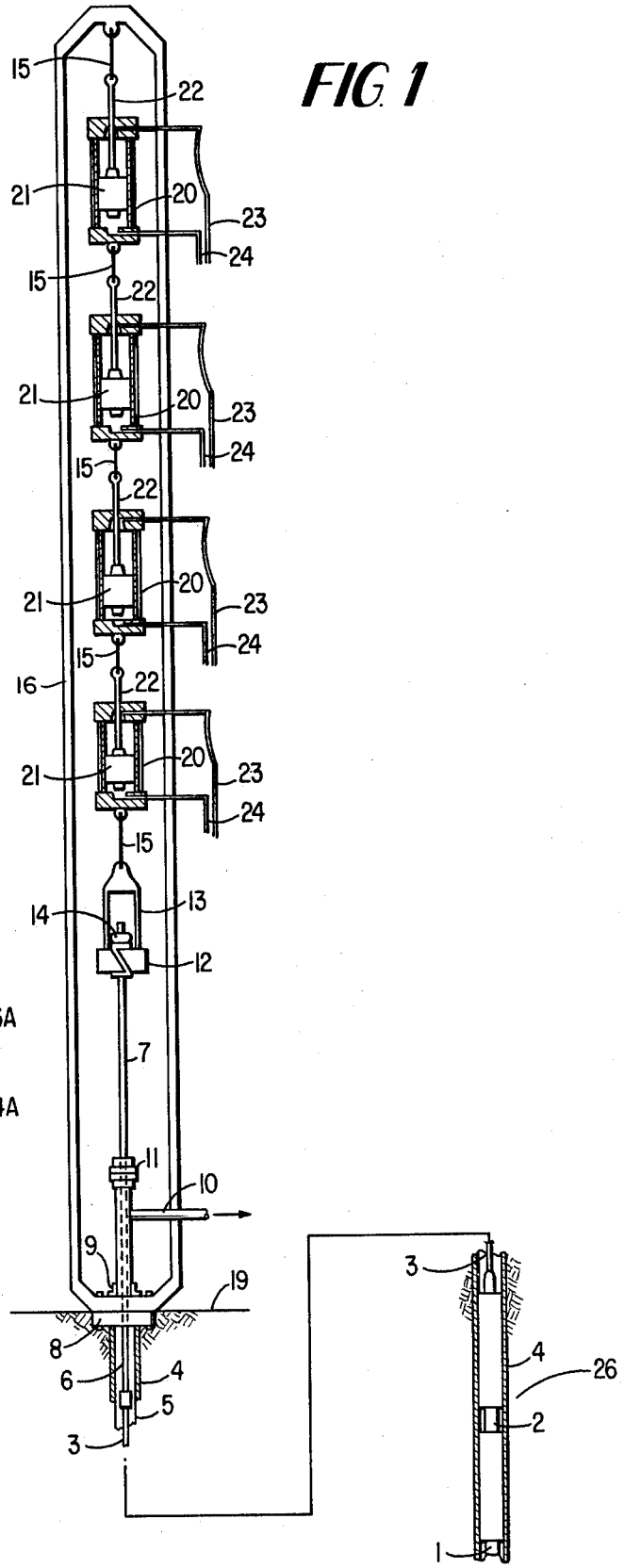
FIG. 1 is a partly sectional and partly elevational view of a preferred embodiment of multi-cylinder system in accordance with the invention, suspended from a frame which is bolted to the well casing head.

In describing the preferred embodiments of the present invention, which are illustrated in the drawings, specific terminology will be resorted to for the sake of clarity. However, the invention is not intended to be limited to the specific terms so selected, and it is to be understood that each specific term includes all technical equivalents which operate in a similar manner, to accomplish a similar purpose.

Figure 2:
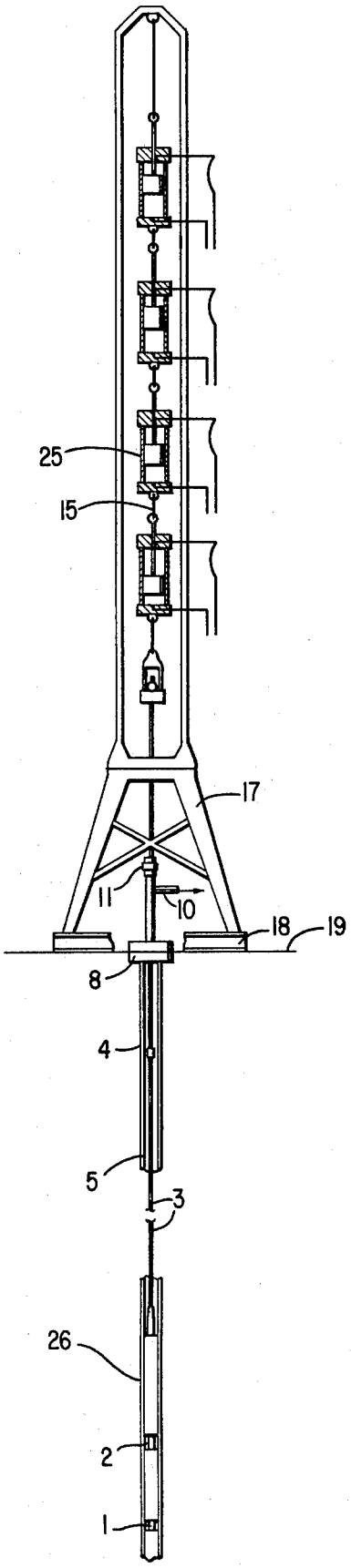
FIG. 2 is a partly sectional and partly elevational schematic representation of the multi-cylinder system of the invention, suspended from a frame which is independently supported on an I-beam platform.

With reference to FIGS. 1 and 2, the preferred embodiment with respect to the hanging multi-cylinder pumping unit according to the present invention will now be described. The oil is urged upwardly toward the surface of the well by way of a subsurface or downhole pump 26 which conventionally includes a standing valve 1 and a traveling valve 2. The traveling valve 2 is connected to the bottom of the sucker rod assembly (which can include a plurality of rods connected together) with the sucker rod being shown in the drawings as 3. As is known with respect to conventional subsurface oil well pumps, the traveling valve is opened by the downstroke of the sucker rod, such that oil located in the lower chamber of the pump flows into the upper chamber of the pump which has moved downwardly. During the upstroke of the sucker rod, the travelling valve is closed and the oil within the upper chamber of the pump is moved upwardly, thus lifting all the oil in the tubing up toward the surface of the well. At the same time, the standing valve is opened, and the partial vacuum which is created by the upper chamber of the pump moving upwardly results in oil flowing into the lower chamber of the pump, since the standing valve has been opened. This explanation of the operation of a subsurface oil well pump is merely by way of example, and is not considered to be a part of the invention. A conventional subsurface pump for pumping oil upwardly through tubing is shown in U.S. Pat. No. 2,530,673 to Zinszer. There are many other types of subsurface pumps. It is to be understood that any subsurface oil well pump which can be operated by a reciprocating motion within the well casing can be used for the purposes of the present invention.

The sucker rod 3 is an assembly of a string of sucker rods extending from the pump all the way to the connection with the polished rod, or might simply be one cable or rod which extends from the pump to the polished rod. The lower end of the polished rod is indicated at 6, and the upper end is indicated at 7. The well casing is indicated at 4, and the tubing through which the oil flows upwardly is indicated at 5. The tubing is suspended from tubing ring 9, and the well casing head is indicated at 8.

The oil is pumped upwardly through the tubing and into a tee 10, which directs the oil to piping and tank batteries, which are not shown in the present drawings. Stuffing box 11 prevents the oil from rising upwardly around the polished rod, rather than exiting through the side pipe of the tee. The stuffing box (packing box) contains a non-rigid material such as rubber, and is akin to the stuffing box on a boat, through which box the shaft passes from the hull to the water. As indicated above, the sucker rod is connected at its lower end to the moving part of the subsurface pump. The upper end of the sucker rod is connected to the polished rod, which is in turn connected to the polished rod carrier bar 12, by way of the rod clamp 14. The carrier bar is connected to the lowest cylinder, of the multiple cylinder assembly shown in FIGS. 1 and 2 via wire-line 13, which can be a cable (made for example of wire) or can be a rod.

Figure 3:
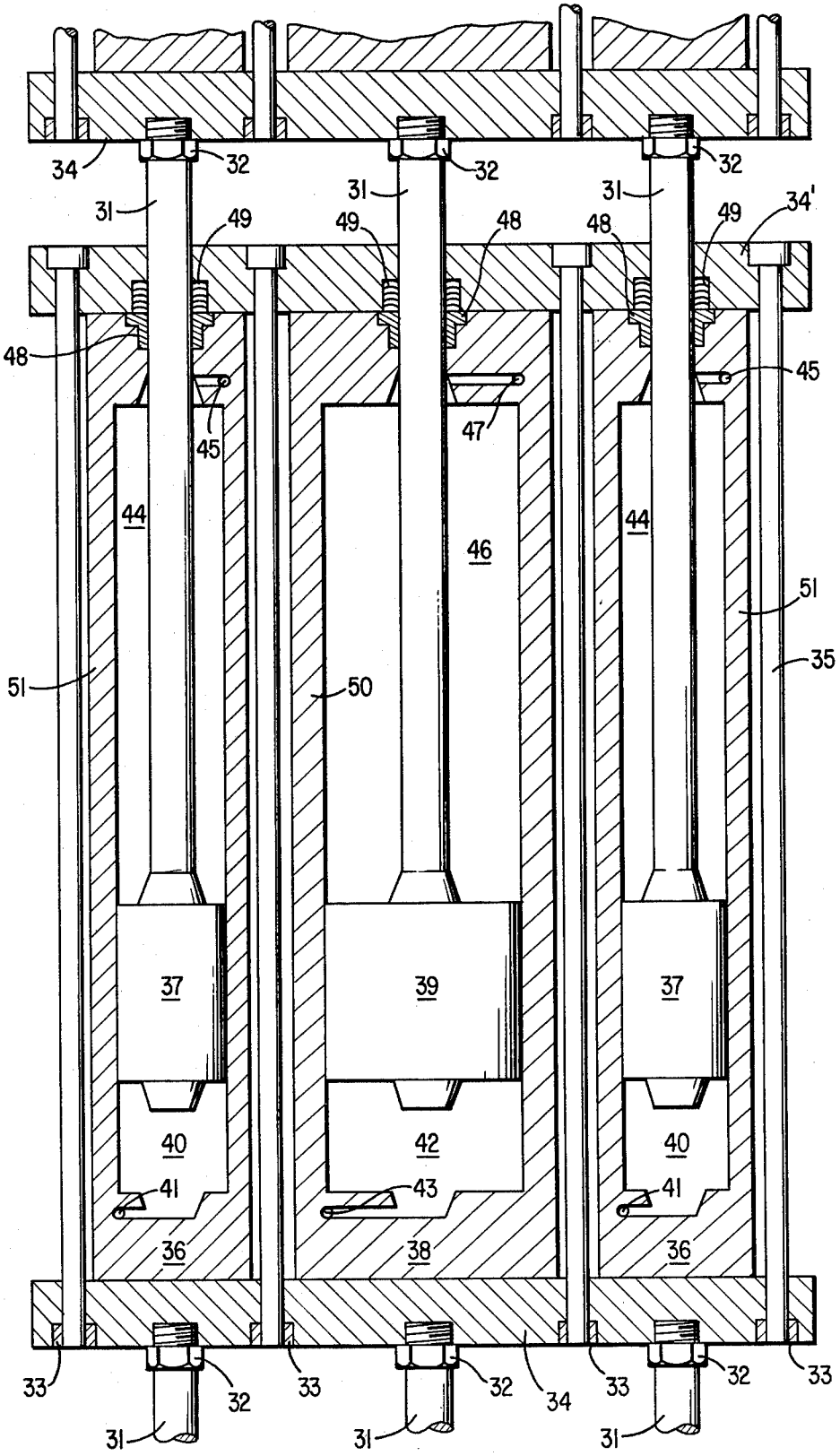
FIG. 3 is a sectional lengthwise view of one embodiment of a working cylinder according to the present invention, having two pneumatic energy storage cylinders located on either side of the working hydraulic cylinder.

The multi-cylinder system includes a plurality of cylinders 25 having housings 20, with the number four (which is shown in the drawing) not being critical to the present invention. The cylinders 25 are held together by tie rods 20, 15 and have pistons 21 and piston rods 22. The structure of a working cylinder 25 usable with the present invention can be understood by reference to the working cylinder shown in FIG. 3, which will be discussed below. However, the structure of the working cylinder shown in FIG. 3 is not critical to the invention, and any expansion member which can be expanded and contracted using hydraulic fluid and will perform the purposes of the present invention can be used herein. For example, a cylinder might have two pistons with each being connected to a piston rod protruding out of each end of the cylinder, where fluid is fed between the pistons to move the rods outwardly and fluid is fed to the upper and lower cavities of the cylinder to move the pistons and rods together. It should also be noted that the section shown for the cylinder of FIG. 3 can represent a cylinder which is circular in cross section, or can represent a cylinder which is square in cross section, or any other geometric shape, for which the cylinder can surround the piston. Of course, the geometric shape of the piston will conform to that of the cylinder housing. Thus, for example, a hexagonal piston might be located within a hexagonal shaped cylinder having a hexagonal cylinder housing. However, a circular cylinder and piston are preferred.

Figure 7:
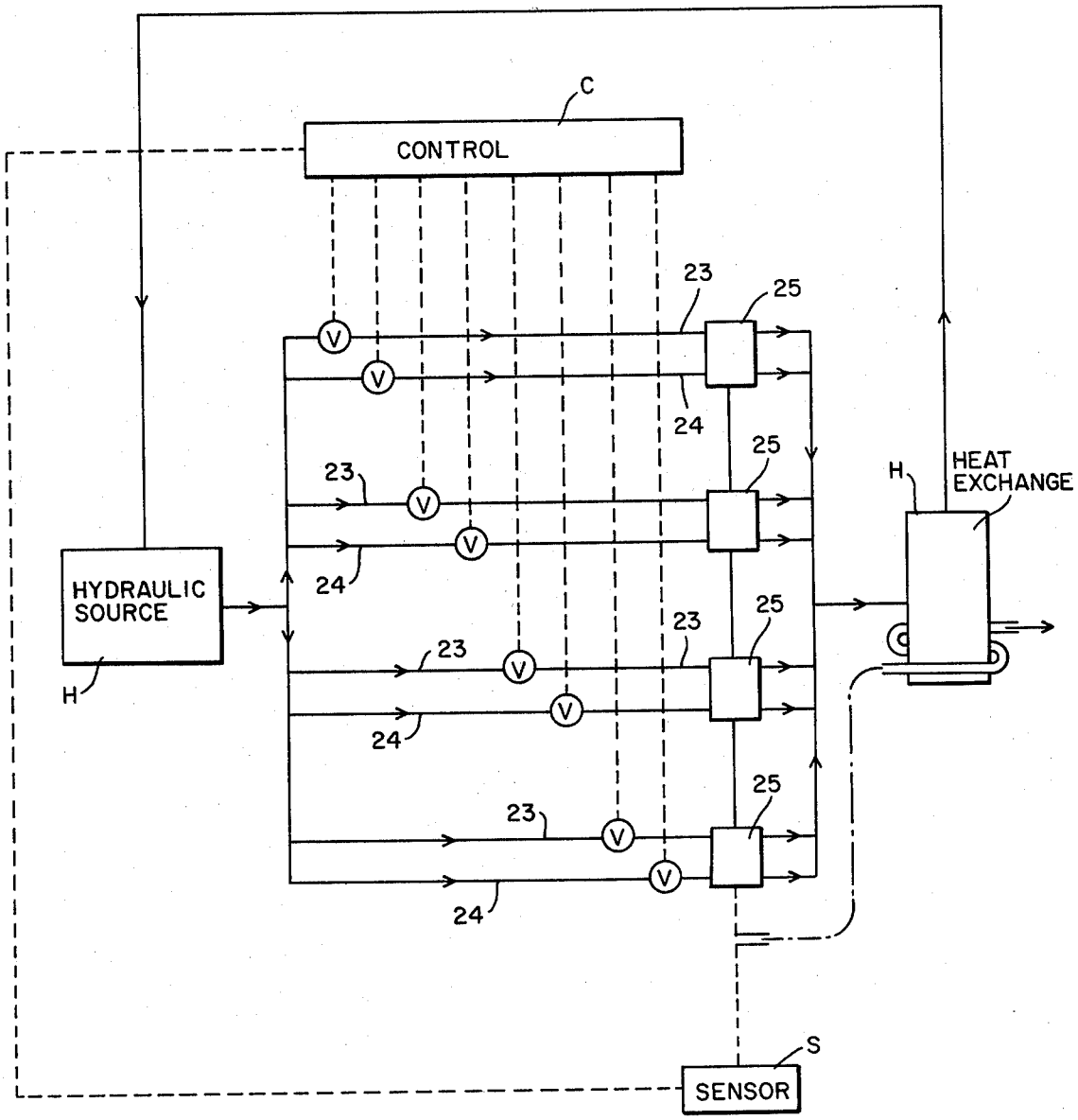
FIG. 7 is a schematic illustration of a pumping installation incorporating the multi-cylinder system provided by the present invention.

Hydraulic fluid can be flowed from sources schematically illustrated in FIG. 7 through hydraulic fluid lines 23 and 24 to either the upper or lower chambers of each cylinder. When fluid is flowed inwardly through hydraulic line 23, the cylinder moves upwardly relative to the piston 21. When fluid is flowed inwardly through hydraulic line 24, the cylinder is moved downwardly with respect to piston 21. As can be understood, the movement of each cylinder in an upward direction will contribute to the movement of the polished rod, sucker rod system, and moving portion of the pump in an upward direction. Movement of a cylinder in a downward direction will contribute to moving the above-mentioned elements in a downward direction.

As shown in FIG. 7 of the present drawings, any conventional control means can be used to control when fluid is provided to either of lines 23 or 24, how much fluid is flowed per unit time, and which of the cylinders will receive fluid. The control means can be made responsive to downhole conditions and to failure of one of the cylinders by any conventional sensing means with feedback to the control means.

Connecting and suspending members 15 will connect piston rods 22 and cylinders 25, and will also connect the multi-cylinder system to frame 16. Connecting and suspending members 15 can be wireline or rods or anything that will support the weight of the cylinders, polished rod, sucker rod assembly, and oil being pumped. The suspension of the connecting and suspending members 15 is such that the connection permits movement in any direction. Thus, for example, a ball-in-socket connection might be used, or a plurality of hinges might be arranged such that the cylinder system can completely center itself in line with the gravitational force. While it is critical that a gravity centering (connecting and suspending) member 15 be hung from the frame 16 in order to permit centering of the cylinder system, it is preferable to also employ a gravity centering member 15 between each of the cylinders of the cylinder assembly, such that a member is connected to the piston rods of each cylinder, and the end of the next cylinder in line.

Figure 5:
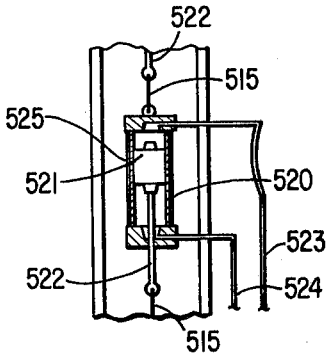
FIG. 5 is a partially sectioned view of another embodiment of a working cylinder in accordance with the present invention.

While FIGS. 1 and 2 show the positioning of the multi-cylinder system such that the piston rods extend upwardly, the invention can equally be practiced in a manner, as shown in FIG. 5, such that the ends of the cylinders 525 are suspended from above, and the rod 522 of piston 521 extends downwardly to be connected with the next lower cylinder via member 515, with hydraulic lines 523, 524 being provided to furnish hydraulic fluid to cylinders 525.

Figure 6:
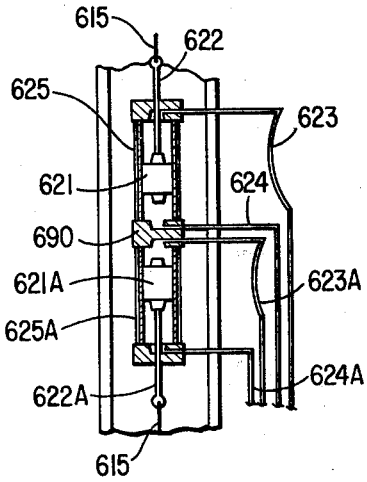
FIG. 6 is a partially sectioned view of another embodiment of a working cylinder according to the invention.

Further, as shown in FIG. 6, the cylinders can be aligned such that the cylinder ends of two adjacent cylinders 625, 625A are connected at 690, while the piston rods of two other adjacent cylinders are connected to rods 622, 622A via the connection member 615. Thus, although it is not the preferred embodiment of the present invention, the cylinders of the multi-cylinder system can be aligned such that the piston rod of one cylinder is connected to the piston rod of the cylinder immediately above it, and such that the end of the cylinder is connected to the end of the cylinder immediately below it. Thus, sets of cylinders facing each other (as two piston rods and as two cylinder ends) can be provided within the multi-cylinder system. Expansion and contraction of stroke would be accomplished by this embodiment of the invention in the same manner as described above via hydraulic lines 623, 624, 623A and 624B, this face to face association of cylinders or rods forms a part of the present invention. In the case of a cylinder having two pistons as in the example mentioned above, all connections will be piston rod to piston rod.

The vertically aligned multi-cylinder system may be located above the ground and supported by frame work either bolted directly to the casing head as shown in FIG. 1 or independently supported upon a conventional foundation of gravel, wooden or steel beams, concrete, or a combination thereof. FIG. 2 shows the use of steel beams, with reference to frame 17 which is independently supported on an I-beam platform 18. It is possible to locate the fluid cylinders 25 just below the ground level 19, within the well casing, while it is also possible to locate the fluid cylinders 25 downhole nearer to the level of the fluid to be pumped. The structural connecting members 15 between the multi-cylinder system and the framework, and between the piston rod of one cylinder and the casing or cap of the next cylinder can be either rigid or flexible as long as the ultimate connections involved permit gravity centering.

The gravity centering of the present invention is obtained by hanging the cylinder system from above. Gravity and the weight of the sucker rod and fluid column combine to naturally maintain alignment of the system. Because the multi-cylinder system is centered over the well, the frame may easily be aligned at set-up by suspending a plumb bob from the suspension point of the frame to the center of the well head.

The piston of each cylinder is connected to the next cylinder, so that individual piston displacements are additive to give a total system displacement, and a desired stroke length for pumping the oil. As pointed out above, the pistons may protrude from the cylinders toward the well or in the opposite direction away from it. In either case, extension of the pistons will produce linear movement toward the well and retraction of the pistons will produce a reciprocal linear movement away from the well. The pistons can all be extended in the same direction at the same time, in order to provide maximum stroke length for the system, or some pistons might be moving upwardly while others are moving downwardly, or a piston might not be moved at all while the other pistons are being moved. The desirability and instances for regulation of piston movement will be discussed in more detail below.

As illustrated in FIG. 7, an installation incorporating one embodiment of the pumping unit provided by the present invention includes a hydraulic source connected by a plurality of lines 23 and 24 to the individual cylinders 25. Flow of hydraulic fluid through the lines is controlled by valves V. The valves V, in turn, are controlled by a control unit that controls the piston stroke phasing of the cylinders in the multi-cylinder system. In one embodiment, the control is such that the piston stroke of each cylinder terminates sequentially and slightly out of phase with the stroke termination of the next adjacent cylinder to provide a smooth and dampened reciprocating action to a rod connected to the lower connection means. Further, it is preferable that the control of the piston stroke phasing of the cylinders is such that there is at least one leading cylinder and at least one trailing cylinder, with the leading cylinder being controlled to begin a reversal of stroke direction just as the trailing cylinder is completing a stroke.

In the embodiment illustrated in FIG. 7, a sensor S is provided in the downhole of a well to sense conditions within the downhole. Signals generated by the sensor S are fed to the control so that the control regulates the action of the cylinders 25 of the multi-cylinder system in response to signals generated by the sensor S.

Further, the control makes it possible to control the direction of fluid flow to and from the cylinders in order to regulate the stroke length of each cylinder and provide the desired stroke length smoothness of pumping and stroke speed of the overall multi-cylinder stroke during different stages of the overall stroke.

FIG. 7 illustrates still another feature of the present invention. Specifically, the hydraulic fluid fed to the cylinders of the multi-cylinder system is discharged from the cylinders, cooled, and returned to the hydraulic source. Preferably, a heat exchanger is provided so that well effluent is brought into thermal contact with the hydraulic fluid so as to provide cooling of the fluid.

Although the drawings show the cylinders of the present invention to be double acting with upper and lower hydraulic chambers, the fluid cylinders may be single acting, with one hydraulic chamber, and one chamber which is vented to the atmosphere. In such a case, the hydraulic chamber will be used to lift the sucker rod assembly, while gravity will be used to lower it. The cylinders also might have one hydraulic chamber and one pneumatic or vacuum chamber acting as a counterbalance and/or booster. In the use of hydraulic chambers for the cylinders, a benefit is derived from conventional hydraulic/pneumatic accumulators within the fluid circuit to act as counterbalances to the rod and fluid weight, and to receive and store for use on upstroke excess pump output and energy generated during the downstroke. A system for storing excess pump output and energy generated during downstroke is shown in U.S. Pat. No. 2,665,551 to Chenault, and the disclosure of that patent is hereby incorporated by reference. Further, and as a preferred embodiment of the present invention, a pneumatic cylinder or pneumatic cylinders positioned laterally to and acting together with the working hydraulic cylinders of the cylinder system can be used as an alternative to the accumulators within the fluid circuit as discussed. The use of pneumatic cylinders positioned laterally to the working hydraulic cylinder and acting with it can be seen by reference to FIG. 3.

FIG. 3 shows two pneumatic cylinders 36 which are positioned on either side of a central working hydraulic cylinder 38. Although two pneumatic cylinders are shown positioned laterally beside a given hydraulic cylinder in FIG. 3, any number of pneumatic cylinders could be positioned as such, and still be within the present invention. The pneumatic cylinders 36 operate in tandem with the working hydraulic cylinders 38 with which they are associated. In the present case, a triplet of cylinders is shown, and this triplet may be repeated as often as wished, to make up a vertically aligned system. As can be seen, the vertical movement of the pneumatic cylinders is necessarily identical to the movement of the working hydraulic cylinders with which they are associated. In FIG. 3, it can be seen that the piston rods 31 of one triplet of cylinders can be conveniently connected to the next triplet of cylinders, by screwing the piston rods into the end plate 34 of the next triplet of cylinders. Such connection is facilitated by the positioning of adjusting nuts 32 on the rods 31.

In operation of the triplet, the upstroke in which the sucker rod assembly is raised will first be described. Fluid is forced into cavity 46 forcing the piston 39 relatively downward within cylinder 38 and cylinder housing 50, thereby contracting the assembly. As this occurs, the counterbalance pistons 37 assist the action by using energy from the gas in cavities 44 which gas was compressed on the previous downstroke and also using the vacuum created in cavities 40 which vacuum was also created on the downstroke.

On the downstroke, fluid is fed to cavity 42 (or if desired, gravity may simply be relied upon), and pistons 39 and 37 move upwardly relative to the cylinders of the triplet. The upward movement of counterbalance pistons 37 serves to compress the gas in cavities 44, and to enlarge the partial vacuum in cavities 40, and this stores gravitational and excess hydraulic energy for use in the next upstroke.

With respect to the assembly of the triplet, it should be noted that the cylinders are held in place by way of end plates 34, 34' which are secured by tie rods 35. The tie rods are inserted within countersunk bores in the end plates, and are tightened by screwing tie rod nuts 33 within the countersunk bores. Rod seals 49 and rod bearings 48 are also provided with respect to the piston rods for each of the cylinders, as shown in FIG. 3, and fluid ports 41, 43, 45, and 47 are provided in and through the cylinder housings 50 and 51 for introducing hydraulic fluid into respective cavities 40, 42, 44, and 46 as necessary. The conventional valves which are not shown will obviously regulate whether fluid is or is not introduced through the fluid ports. The valves can be constructed such that they simply permit the entry of fluid at a certain flow rate or prohibit the flow of fluid or the valves can also be constructed to regulate the rate and direction of fluid flow as time progresses (although this is less desirable, since complicated valve mechanisms are needed).

As pointed out above, the pneumatic cylinders of the invention may be mounted as shown (with the piston rods 31 facing up), or the cylinders can be mounted with the piston rods facing down if desired. Further, any or all of the (working) cylinders shown in FIGS. 1 and 2 can be provided with laterally positioned pneumatic cylinders. Where the connection between the piston rods and the cylinder is to be by way of connecting and suspending member 15, the assembly of FIG. 3 would be modified by screwing piston rods 31 into one side of a separate plate member, and then attaching suspending member 15 to the other side of that plate member and to the end of the next cylinder.

With respect to FIG. 3, the end plates can be rectangular, square, or circular (or any other shape), depending upon the desire of the artisan. Further, the cylinders and pistons can be square, rectangular, or circular (or any other shape), again depending upon the desire of the artisan. Thus, it is within the present invention that pistons 37 can simply be two square or round pistons which are located on either side of square or round piston 39 with the cylinders also being either square or round. As a further embodiment of the present invention, two further pistons 37 can be located in front of and in back of piston 39 together with their respective cylinders, where a square end plate 34 is used to accommodate the entire assembly. Further, piston 37 can be an annular member extending around piston 39, with 51 representing an annular housing. Further, the mechanism could also work well with cylinders sliding within each other (compound cylinder with one cylinder acting as the piston).

As pointed out above, the embodiment of FIG. 3 is merely a preferred embodiment, and is not required for the present invention as can be seen by FIGS. 1 and 2 which do not have such a counterbalancing cylinder assembly.

With respect to the hydraulic power required to operate the multi-cylinder system of the invention, such may be supplied by any conventional hydraulic prime mover, powered by gas, liquid fuel, or electricity. Thus, for example, a direct drive electric motor, a belt driven oil field type gas engine, or a diesel powered engine might be used for the prime mover. In order to transmit power from the prime mover to the pistons of the cylinders, a conventional motivating pump such as a reversible variable displacement pump or a centrifugal pump can be used. Any motivating means which can feed fluid to the cylinder cavities under sufficient pressure and thereafter permit withdrawal (discharge) of the fluid from the cavities can be used for the present invention. Any other conventional hydraulic circuitry such as the hydraulic-pneumatic accumulator can be used where appropriate in order to facilitate operation of the hydraulics in the present invention. The power source and controls for the hydraulic flow into the cylinders of the invention can be located at a source either distant or near the well head, again as desired.

The hydraulic lines 23 and 24 can be connected to a single hydraulic feed system and power source; however, there may be applications where each cylinder would have its own feed circuitry and power source. In certain instances, there may be provided one power source to run most of the cylinders, while another power source or sources run the remaining cylinders. For example, if the number of strokes per minute of an operating pumping unit must be increased beyond the capacity of the prime mover, and the stroke length is to remain the same, an additional power source can be added to the hydraulic system in order to power one or more of the cylinders, without having to change the stroke length or number of hydraulic cylinders.

In using the multi-cylinder system of the invention, individual cylinders may be added to or subtracted from the system. This facilitates adjustment for changing stroke length demands over time as is now common in the evolution of producing oil and gas wells. As with conventional single hydraulic cylinders, stroke length can also be altered by shortening the extension/contraction cycle, and stroke time can be altered simply by changing the volume per unit of time of the fluid entering (and leaving) the cylinder chambers. Stroke lengths can most easily be changed by altering the phasing of the individual cylinders as described below. Because matching of well demands and pumping units is a multifaceted problem and often involves rough estimates, the innate variability of the multi-cylinder system of the invention provides a decided advantage both in terms of time and cost. In the system of the invention, when one cylinder becomes frozen or otherwise inoperable, pumping is continued by modifying either the phasing of the other cylinders or possibly the amount of fluid fed to the other cylinders (although modifying the amount of fluid fed is not preferable, since this requires a more complicated variable valving system).

The aspect of easily or automatically changing or altering the stroke period or length in response to changes in downhole conditions would be very advantageous to the following pumping situations:

1. Bringing on new wells which tend to be unstable or erratic during the initial production period.
2. Surging wells in which fluid flow and pressure may substantially change several times a day.
3. Any well which requires close observation and numerous changes in pumping unit settings.

Figure 4:
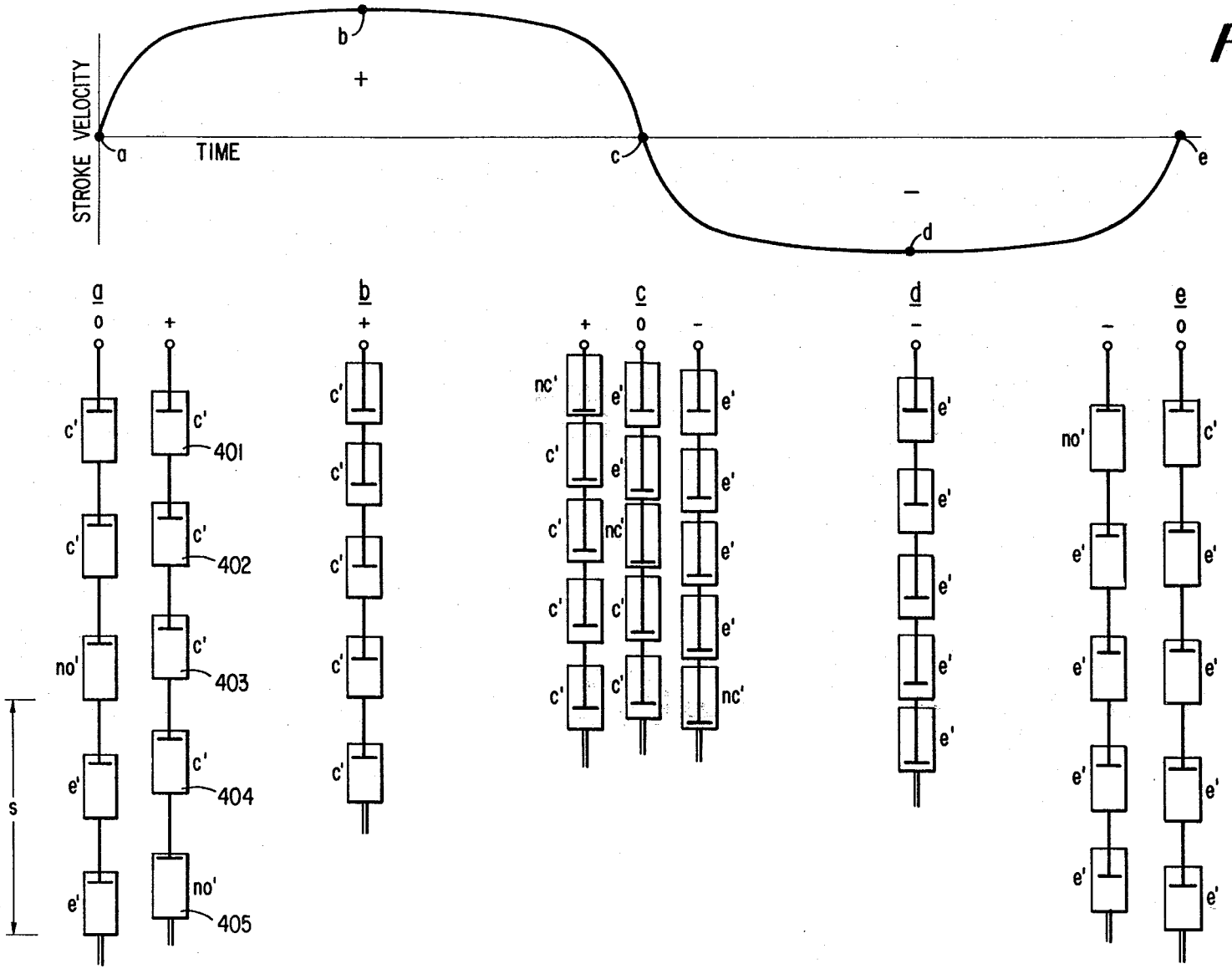
FIG. 4 is a diagrammatic representation of the sequential action of the multi-cylinder system.

An important aspect of the invention which can be obtained via the multi-cylinder assembly of the present invention can be understood as follows. Historically, one of the major problems in reciprocal pumping unit design has been meeting the increased stresses which are imposed during the reverses in reciprocal action, particularly when changing from downstroke to upstroke. Reverses should proceed at a more gradual pace than the straight upstrokes and downstrokes; however, this has been difficult to achieve. In a distinct advantage of the aligned multi-cylinder system, according to the invention, the reciprocating actions of the cylinders may be phased such that the reverses in direction of motion of the individual cylinders proceed in a sequential order. The sum of the sequential movements of the individual cylinders thus produces a smoother more gradual transition than is possible, with a single hydraulic cylinder, without use of special and complicated valving. This can be illustrated by the following example of a five cylinder system, as exemplified in FIG. 4. In the graph of stroke velocity over time as shown in FIG. 4, the plus sign represents the upstroke portion, the minus sign the downstroke portion, and zero represents stroke termination of the pumping unit. With respect to the individual cylinders 401-405 shown in the schematic diagram of FIG. 4, each cylinder is represented as being in the states of expanding, contracting, neutral open, and neutral closed by the symbols e', c', no', and nc'. The positions a, b, c, d, and e of the cylinders correspond to the movement of the pumping unit through its complete upstroke and downstroke.

In a five cylinder system, the termination, transition or reverse point for the system as a whole is reached when two cylinders 401, 402 have just passed their individual transitions (full extension) and two cylinders 404, 405 are nearly approaching their transition points (full extension), while center cylinder 403 is at a neutral open position. As the overall contraction of the stroke is begun, three cylinders 401, 402 and 403 are actually beginning the contraction, and therefore the contraction in stroke begins gradually, since cylinders 403 has just passed its neutral open position, while cylinders 404, 405 are still expanding. As cylinders 403, 404, 405 begin their contraction, the velocity of contraction is increased to the steady state point b for the upstroke. Upon completion of the upstroke at the point c where the desired stroke length s is being attained, cylinders 401, 402 are still moving to complete the increase in stroke length, cylinders 404, 405 are contributing to stroke decrease, and center cylinder 403 is at a neutral closed position. Thus, the extension to the desired stroke lengths is completed with a gradual termination, since all five pistons are not moving to complete the stroke, but rather one at a time. Completion of the downstroke through points d and e is similarly carried out. Therefore, it can be seen that the present invention will provide a dampened reciprocating action for the stroke by properly controlling the phase of the pistons of the cylinder-assembly.

This concept of some cylinders reversing direction as other cylinders are finishing their travel in one direction provides, in sum, a smooth transition between downstroke and upstroke and between upstroke and downstroke. As a piston within a hydraulic cylinder finishes one direction of stroke, there is a lag period where the piston does not move, while the control mechanism changes conditions (for example, flow valves are changed from opened to closed), such that the piston is now ready for movement in the reverse direction. During this period of time, no movement (of the individual cylinder) in either direction is obtained. Further, since the piston is stationary for a brief period of time, movement is not smooth. This has jerking or jarring effect, imposing stress on the sucker rod assembly and the subsurface pump itself. By use of the presently described procedure with sequential reversing pistons, this problem is mitigated. While the leading piston is stationary, due to the above-described lag, the trailing pistons are still increasing the stroke. After the trailing pistons have reached their full extension, the pistons all begin to contract. Thus, the system will go from gradual termination of downstroke velocity to gradually increasing velocity of upstroke, until a steady state velocity of contraction (upstroke) is obtained. This procedure will provide rapid attainment of steady state stroke velocity, yet permit both a gradual change from downstroke to upstroke. It will in the same manner, give a gradual and smooth change from upstroke to downstroke.

A less smooth but dampened reciprocating action can also be provided by terminating the stroke of two cylinders slightly out of phase to the stroke termination of the next two cylinders. It can be seen that the greater the number of cylinders in sequence, the smoother the termination.

Sequential action is accomplished by regulating the timing for which fluid will enter and leave the cylinders, by use of sequential valves. An electrical and/or mechanical system can be used to control all of this.

It should be noted that various hydraulic control mechanisms are available as components which may be combined to enable automatic sequential operation of the present multi-cylinder system. A series of main five-way control valves, one for each cylinder, may in turn be pilot controlled by a similar number of secondary sequence valves so that transition from downstroke to upstroke (and vice versa) is carried out sequentially. Further, variable control of the input to the series of secondary sequence valves will easily allow variation of the duration of the total system transition time, thus producing the desired degree of stroke damping in reciprocal motion. Though not the preferred embodiment, it would obviously be possible to operate the multiple cylinders simultaneously or with one designated cylinder leading or lagging the others and acting as a motion damper.

It is important to be able to regulate the speed at which stroke termination is accomplished, in accordance with the depth of the hole involved, the fluid level in the hole, the fluid flow rate, and other downhole conditions. The closer the action of the cylinders, the more rapid will be the stroke termination and the longer the stroke. Conversely, the further away from each other the action of the individual cylinders, the more gradual the termination and the shorter the stroke (and the greater the overall power or lift). If half the cylinders are in opposite phase to the other half, there will be no overall motion. Thus, it can be seen that through phasing of the individual cylinders in respect to each other, overall stroke length, termination time and lift power can be altered to suit the desired condition. The action of the cylinders can be regulated via the present invention to accomplish the stroke action desired, without the use of special valves, in addition to the hydraulic valves which permit flow into the cylinders. The individual cylinder's strokes can be lengthened (within the range of the individual cylinder's fluid capacity) by lengthening the hydraulic fluid injection cycle, and shortened by the converse. The simplicity of control via the present invention is quite clear, and chances of malfunction are reduced, since the timing of the hydraulic valve action is the only thing which need be regulated. Thus, it can be seen that the rate of fluid flow into the cylinders need not be changed, as the stroke progresses upwardly and downwardly; since the phasing of the cylinders will accomplish the same result. All that is required for the valves of the present invention, is that they be able to permit a steady but timed flow of hydraulic fluid into and from the cylinder.

In using the multi-cylinder system of the present invention, the pumping unit's frame or derrick, whether attached to the well head (annulus) or ground supported, is centered with a plumb-bob (gravity) hung from the point-of-attachment of the top most cylinder (or piston rod). Once the frame is centered and secured over the polished rod, the hydraulic cylinder assembly is hung from the point-of-attachment. Gravity then maintains the alignment and plumb of the hydraulic cylinder assembly. The lowermost cylinder (or piston rod) is then attached to the polished rod. The stuffing box is then screwed onto the top of the tee such that oil flows through the side pipe of the tee, and the system is ready for reciprocal pumping of the oil out of the well.

According to another facet of the invention, after the hydraulic cylinder assembly has been gravity centered, a member can be rigidly fixed to the frame and further rigidly fixed to the top cylinder. The member can be fixed, such that the cylinder assembly can no longer sway in any direction, but the cylinder assembly remains gravity centered. This member (which can be for example a suitable housing, brace or bracket, slide or track) can remain in position, until the pumping unit is finally removed and moved to another well location. The use of a member which rigidly fixes the gravity centered multi-cylinder system to the frame (after gravity centering) is considered an advantageous modification of the present invention, since the rigidity of the multi-cylinder system may be used more effectively to increase stroke speed in the downward direction, though this is not the preferred embodiment. Where gravity centering members are used between adjacent cylinders, bracket or brace, slide or track or guide like members would be fixed to each cylinder side or end, perhaps, and each piston rod. Note that a rigid member could be fixed between every connection point on the multi-cylinder system and its connection to the polished rod, and the polished rod's connection to the sucker rod, in order to insure that the entire mechanism reciprocates rigidly, if the time required for the downstroke is to be increased over that of free fall velocity of the rods.

Another embodiment of the present invention is as follows. When the hydraulic fluid exits from the cavities of a working hydraulic cylinder, it can be very hot from friction. The hot fluid can be cooled by feeding it to a conventional heat exchanger, such as a shell and tube exchanger. The cooling fluid of the invention is the cool well effluent which usually includes water and oil. The effluent is flowed into heat transfer contact with the hydraulic fluid, and the fluid can thereafter be returned to the hydraulic cylinder cavities. The cooled hydraulic fluid will cool the hydraulic cylinder, and thereby increase the useful life of the cylinder.

In view of the above disclosure, the advantages of the invention will be appreciated as follows.

Gravity centering of the multi-cylinder unit is important because the polished rod must travel through the center of the wall annulus in a vertical reciprocating motion, strictly aligned with gravity. If the pumping action is off-center, the polished rod will wear its seals in an effort to center itself, and will throw the sucker rod off center, causing the sucker rod to hit and wear the walls of the tubing downhole. Further, if the system is not centered, and the sucker rod system scrapes the walls of the surrounding tubing, the sucker rod system can break, or be damaged by twisting and bending. Even further, there can be undesirable twisting and breaking in an effort for one part of the system to center itself while the remainder of the system remains uncentered (as throwing the pumping unit itself out of position).

It is noted that in a prior art HEP pumping unit, a single hydraulic cylinder (with a counterbalance system) has been rigidly fixed to a frame, for recriprocating a downhole pump. In this arrangement, a cable such as wire-line 13 (seen in FIG. 1) is used to suspend the polished rod from a polished rod connector, which connects the vertically fixed piston rod of the system. Thus, the HEP unit requires close tolerance vertical positioning rarely attainable and seldom maintainable in field applications where extremes of weather, frost and mud hamper close tolerance centering. Consequently, the piston rod seals which are located in the cylinder above the cable (wire-line) will be worn as the piston lifts and lowers the polished rod and sucker rod, since the rigidly connected piston and cylinder assembly will be on a slant, as compared to the gravity aligned polished rod. Thus, the weight of the polished rod will be pulling downwardly, while the piston will be pulling the polished rod connector (located immediately above the cable) on a slant.

Therefore, it can be seen that the gravity centering member of the present invention which is located above the cylinder apparatus, and which is attached to the top of the frame, provides for the centering of the entire assembly, so as to minimize wearing of seals or the sides of the cylinder, or polished rod seals or any other part of the entire system. It can also be seen that the present invention permits the assembly to freely swing in any direction (via a connection such as a ball and socket linkage or a multiplicity of hinges which accomplish the same thing), so that the assembly will be completely centered within itself and on its supporting frame, and there will thus be less wearing of the polished rod seals in any direction, and the sucker rod should not be thrown off in any direction. When the large amount of weight of the sucker rod and the oil being pumped are taken into account, in conjunction with the great number of strokes for an oil pumping unit, the mitigation of wear to the walls of the tubing, to the rods, and to the piston assembly, is understood to be essential.

As compared to currently available alternates, pumping unit of the present invention is further advantageous in that it is easy to transport, easy to set up and maintain, and can be matched to the demands and needs of any well. The frame and multi-cylinder rigging shown in FIG. 2 are light in weight and all that need be transported from one location to another. Thus, the hung cylinders can be collapsed and removed from the frame, or if desired further taken apart to provide individual cylinders. (Of course, the polished rod, common to all above ground pumping units, is disconnected from the cylinder assembly first.) After removal of the cylinder assembly which has been hung, it is only necessary to transport the light frame on a truck, or like vehicle. As pointed out above, the hydraulic fluid source can be at a location distant from the pumping operation, and it is only necessary to provide hydraulic lines or hoses running from the hydraulic fluid source to the new well to be pumped. Thus, it can be seen that the rigid heavy pumping unit apparatus of the prior art is entirely avoided. It is important to understand that a very high maximum length of desired stroke can be provided for the pumping unit, without having to worry about a high rigid unit height (which would provide difficulty in removing and transporting the pumping unit). Thus, in addition to the ease of disassembly of the present pumping unit and transporting it, the collapsibility of the present pumping unit permits a long stroke length, while the pumping unit remains easy to transport.

In setting up the pumping unit, the frame is moved over the well annulus, and is centered with a plumb-bob from the cylinder hanger (the point of attachment of the topmost cylinder (or piston rod)). Next, the multi-cylinder assembly is hung from the cylinder hanger. Then, hose connections, power connections, and the polished rod connection are made, and pumping is started. Thus, it is understood that the pumping unit is easily installed, and requires no unusual foundation or custom site requirements. Once the pumping unit has been set up, it can be matched to most pumping requirements by providing the necessary stroke length, stroke speed, and rated lift capacity. This is done by choosing a hydraulic fluid flow rate for all of or each of the cylinders (and different power sources for each cylinder if desired), by choosing the desired number of cylinders, and by choosing the desired phasing of the cylinders (with respect to each other). Further, the volume per unit of time of fluid entering the cylinder chambers can be adjusted to change with time, as in the prior art; however, this is not needed for the present invention since the cylinder phasing and cycle shortening (or lengthening) will accomplish the same desires. Thus, it can be seen that the innate variability of the multi-cylinder system of the present invention provides a decided advantage both in time and cost, due to the ease of adjustment to a particular well, and ease of setting up for pumping.

The present invention also provides advantages of the pumping unit being easiy maintained, reliable, and flexible to the changing needs of the particular well being pumped. Since more than one cylinder is used for the present invention, the cylinders can be made relatively small, so that engineering demands are smaller than in the case where one larger cylinder would be used. The cylinders are cheaper to manufacture, purchase and replace in the case where a plurality of cylinders are used rather than using one cylinder.

In addition, in the case of a single-cylinder system, the entire system must be replaced upon any failure. On the other hand, a single cylinder of the multi-cylinder system of the invention can be replaced or shut down, in order to remedy a defect in the portion of the system relating to that single cylinder. Where a single cylinder is used, that cylinder must bear all of the friction in the system, and the fluid being fed to that cylinder must bear all of the heat which is generated. On the other hand, the multiple-cylinder system of the present invention permits both the heat and friction to be distributed among a number of cylinders, ports and hydraulic lines. Further, should there be an undesirable heat build-up in one of the cylinders, that cylinder can be shut off, with the remainder of the cylinders being manipulated, if capacity permits, so as to compensate for the shut off cylinder, and to maintain the desired stroke length, stroke speed, and lift capacity. The pumping unit of the present invention is also advantageous in that it has less parts to wear out than conventional pumping units. Further, the parts which are used are generally cheap, off-the-shelf parts.

In using the multi-cylinder system of the invention, individual cylinders can be added to or subtracted from the system with the only limitation being the height of the frame and the power of the prime mover. This provides flexibility and facilitates changing of stroke length demands over time, as is now common in the evolution of producing oil wells. Stroke length can also be altered by shortening the extension/contraction cycle, and stroke time can be altered simply by changing the volume per unit of time of fluid entering and leaving the cylinder chambers. Thus, the multi-cylinder system of the invention can deal with the fact that each well produces differently throughout its life, requiring slowing down of the pumping unit after a period of operation or possibly a shortening of the stroke length. This is normally done by complicated valve regulation; however, it is easily done via the present invention. The parameters for the present invention can be changed simply by changing the volume per unit time for the steady state of the fluid entering the cylinder chambers, and by changing the phasing of the cylinders relative to each other.

In addition to permitting the replacement of a single cylinder which has failed, the present invention permits the pumping operation to continue, even after the failure of a single cylinder. Further, the system can be corrected such that stroke length and stroke strength remain constant, despite the fact that one of the cylinders is no longer operating. This is accomplished for example by shutting off all fluid flow to and from the defective cylinder in the system, and increasing the amount and volume flow rate of the fluid being fed to the remainder of the cylinders. Further, the phasing of the cylinders relative to each other can also be changed to increase the length of the stroke and compensate for the defective cylinder (this will result in a less smooth stroke; however, it will be an advantageous procedure, where the smoothness of the stroke is not critical, and it is critical to continue pumping). Since the present system permits defective cylinders to be easily replaced, and permits the system to continue operating even before the defective cylinder is replaced, loss of revenue due to system down-time and oil flow problems created by discontinuous well pumping will be minimized. With regard to prior art hydraulic pumping units, either only one hydraulic cylinder is used, or a plurality of cylinders having fixedly connected piston rods, and with the cylinders being fixed to each other. The prior art does not provide a system, whereby one cylinder might be easily removed from the remainder of the system. Further, since the prior art piston rods are fixedly connected to each other, the individual pistons cannot be operated out of phase, and cannot compensate for a defect which occurs in one of the cylinders. Further, if excessive heating occurs in one of the cylinders, the prior art piston-cylinder assemblies would need to be shut down, since all of the pistons move together (or there is only one piston). On the other hand, via the present invention, only one of the pistons would be shut down, and the remainder of the pistons would continue to operate.

In addition to the above, the present multi-cylinder system provides for the phasing of the cylinders to provide a smooth stroke where the sucker rod is gradually slowed down at the end of the stroke, and immediately begins traveling in the other direction after the end of the stroke, with this procedure having been described above. This procedure results in a minimum of stress upon the sucker rod and the pump which it operates. The carrying out of this procedure would be impossible, via the prior art hydraulic pumping units, since the hydraulic units could not provide for phasing. In the prior art hydraulic units, lag time between the end of one stroke and the feedback to the control means to the system to begin another stroke will prevent smooth operation of the sucker rod and downhole pump. In using the prior art non-hydraulic pumping units, smooth or consistent operation with gradual slowing toward the end of a stroke would be possible; however, complicated valving would be required, in order to slow the hydraulic flow at the end of the stroke, and subsequently speed up the hydraulic flow after a new stroke had begun gradually. The present invention, however, provides the desired stroke activity with a minimum of difficulty.

As two final points in connection with the present invention, it is to be first observed that the hydraulic fluid fed to and from the cylinders of the invention, and to and from the heat exchanger of the invention, can be fed by means of hoses, pipes, or other easily available conduit members, and pumps or other conventionally available motivating members. Thus, the availability and interchangeability of feed means for the present invention can be observed. Second, it is within the present invention to use the well effluent to cool the hydraulic fluid exiting from a pumping unit, even in the case where the conventional one hydraulic cylinder assembly is used. Thus, the heat exchange embodiment of the present invention represents, in itself, an improvement over the prior art.

The invention has been described in the above specification and illustrated by reference to specific embodiments and the drawings. However, it is to be understood that the invention is not to be limited by the embodiments or the drawings, and is to be limited only by the claims which follow. It is to be understood that changes and alterations in the specific details recited above may be made without departing from the scope or spirit of the invention disclosed herein.

What is claimed is:

1. A pumping unit for reciprocating the rod of a downhole pump for pumping fluid from a well, comprising:

a frame;

a plurality of pressure responsive expansion members coupled together in sequence, each of said expansion members being capable of expanding and contracting to produce a linear reciprocating movement, gravity centering means connected to said frame and to a first one of said sequence of expansion members for suspending said sequence of expansion members to provide gravity centered alignment thereof over the well; and control means coupled to at least one of said expansion members for selectively providing pressurized fluid thereto in order to selectively expand or contract said expansion member;

a last one of said sequence of expansion members being connected to the rod of the downhole pump, whereby the total amount of reciprocating movement imparted to the pump rod is equal to the sum of the individual reciprocating linear movements of each of said reciprocating members being selectively expanded or contracted.

2. A hydraulic pumping unit, capable of driving a downhole pump in a well, such that well-fluid will be brought to the surface of the well, comprising:

(a) a frame having a connection point located at the top of the frame;

(b) a multi-unit assembly including, (1) a plurality of expansion members capable of expanding to an elongated position and contracting to a contracted position, with each expansion member having a connection point at both of its ends, (2) intermediate connection means for connecting each expansion member to the next expansion member immediately above, each connection means being connected to the upper connection point of one expansion member and the lower connection point of the expansion member immediately above it;

(c) suspension means for gravity centering said multi-unit assembly, said suspension means being connected to said connection point located at the top of the frame, said suspension means also being connected to the upper connection point of the topmost expansion member of the multi-unit assembly;

(d) lower connecting means connected to the lower connection point at the bottommost expansion member of the multi-unit assembly, and also being connected to a rod located below the lowest expansion member, such that the rod can be reciprocated upwardly and downwardly by expansion and contraction of said multi-unit assembly; and (e) at least one port means located in each expansion member, capable of passing hydraulic fluid therethrough to result in the expansion and contraction of the multi-unit assembly.

3. A cylinder assembly comprising:

(a) a hydraulic cylinder housing;

(b) at least one pneumatic cylinder housing;

(c) a hydraulic cylinder piston slidably mounted for reciprocal motion within the hydraulic cylinder housing, with a piston rod being fixed to one face of said hydraulic cylinder piston and protruding from said hydraulic cylinder housing;

(d) a pneumatic cylinder piston for said pneumatic cylinder housing, said pneumatic cylinder piston being slidably mounted within each pneumatic cylinder housing, with a piston rod being fixed to one face of each pneumatic cylinder piston;

(e) means for securing said pneumatic cylinder to said hydraulic cylinder, such that said pneumatic cylinder is secured to said hydraulic cylinder in a side-to-side relationship;

(f) means for connecting the pneumatic and hydraulic cylinder piston rods together, such that the pneumatic and the hydraulic cylinder piston rods move together;

(g) port means located in said hydraulic cylinder housing, said port means capable of permitting the entrance and exit of hydraulic fluid to cavities in said hydraulic cylinder, to force the hydraulic cylinder piston to slide within the hydraulic cylinder housing; and (h) means defining a plurality of cavities in said pneumatic cylinder housing, wherein one cavity of said pneumatic cylinder is capable of retaining a compressable fluid such that it is compressed upon movement of the piston rods in one direction, the other cavity of said pneumatic cylinder is capable of retaining a partial vacuum in the cavity, such that the degree of vacuum is increased upon movement of the piston rods in said one direction.

4. A multi-cylinder system containing a plurality of the cylinder assemblies of claim 3, wherein the piston rods of each cylinder assembly are connected to the cylinder end of the next adjacent cylinder assembly.

5. A pumping unit for reciprocating the rod of the downhole pump for pumping fluid from a well, comprising:

a frame;

a plurality of pressure responsive reciprocating units coupled together in sequence, each of said units having a support member and a reciprocating member being displaceable with respect to said support member, said reciprocating member further being mechanically connected to move the next succeeding one of said units;

gravity centering means connected to said frame and to said support member of a first one of said sequence of units for suspending said sequence of units to provide gravity centered alignment thereof over the well; and control means coupled to at least one of said units for selectively providing a pressurized fluid thereto in order to selectively displace said reciprocating member of said unit with respect to said support member of said unit;

said support member of a last one of said sequence of units being connected to the rod of the downhole pump, whereby the total amount of reciprocating motion imparted to the pump rod is equal to the sum of the individual displacements of each of said reciprocating members being selectively displaced.

6. The pumping unit of claim 5, wherein said reciprocating member of each unit is mechanically connected to move the support member of the next succeeding unit.

7. The pumping unit of claim 5, wherein said gravity centering means includes a suspending member connected between said reciprocating member of at least one of said units and said support member of the next adjacent unit.

8. The pumping unit of claim 5, wherein said reciprocating member is a cylinder, and said support member is a piston.

9. A method of pumping fluid from a well having a downhole wherein said well has a downhole pump attached to a rod system, extending from the pump to the surface of the well, said method comprising:

(a) positioning a frame over the annulus of the well;

(b) connecting a multi-cylinder system to a frame connection point at the top of said frame, such that the multi-cylinder system is gravity centered and suspended from said frame;

wherein said multi-cylinder system comprises:

(A) a plurality of cylinders, each cylinder comprising (1) a cylinder housing, (2) a piston slidably mounted within said cylinder housing, and being capable of moving up and down within said cylinder housing, wherein said piston has an upper and lower face, (3) a piston rod fixed at one end to one of the faces of said piston, with the other end of the piston rod protruding from one of the ends of said cylinder housing, and (4) port means capable of permitting the flow of fluid into and out of the cylinder housing, and (B) one or more intermediate connection means for connecting the piston rod or the cylinder housing end of each cylinder housing to the piston rod or cylinder housing end of the next cylinder in the multi-cylinder system, said intermediate connection means being connected between said plurality of cylinders;

(c) connecting the piston rod of the lowest cylinder of the multi-cylinder system to the upper end of the rod system;

(d) feeding hydraulic fluid to the cylinders of said multi-cylinder system, such that the rod system and the moving part of the downhole pump are reciprocated upwardly and downwardly.

10. The method of claim 9, wherein the frame is centered over the well annulus using a plumb-bob which is suspended from the frame connection point before the multi-cylinder assembly is suspended from the frame connection point; and before step (d), the cylinders of the multi-cylinder assembly are connected to a means for pumping hydraulic fluid which is in turn connected to a reservoir of hydraulic fluid, such that fluid can be fed to the cylinders for reciprocal upward and downward movement.

11. The method of claim 9, wherein the stroke of each cylinder piston of the multi-cylinder system is terminated sequentially and slightly out of phase with the stroke termination of the next cylinder piston such that a smooth and dampened reciprocating action is obtained.

12. The method of claim 9, wherein the stroke of the pistons of half of the cylinders of the multi-cylinder assembly is reversed in direction, as the stroke of the pistons of the other half of the cylinders is being completed in a first direction.

13. The method of claim 9, wherein at least one of the cylinders of the multi-cylinder system is operated such that its piston is out of phase with the pistons of the remaining cylinders.

14. The method of claim 9, wherein, after the gravity centering of step (b), the multi-cylinder system, the rod system, and the moving portion of the downhole pump are rigidly constrained together for rigid reciprocal upward and downward movement.

15. The method of claim 9, wherein a plurality of power sources are used to provide fluid to the cylinders of the multi-cylinder system, and different cylinders are provided with fluid by separate power sources.

16. The method of claim 9, wherein the hydraulic fluid is discharged from the cylinders, and is thereafter fed to a heat exchange unit, where it is thermally contacted with the effluent exiting from the well.

17. The method of claim 9, wherein all of the piston rods of the multi-cylinder assembly protrude from the cylinder housing in an upward direction, wherein the feeding of hydraulic fluid to the upper portion of the cylinder housing results in contraction of the multi-cylinder system; and wherein the upper end of the rod system is attached to the lower end of the lowest cylinder of the multi-cylinder system.

18. The method of claim 9, wherein all of the piston rods of the multi-cylinder assembly protrude from the cylinder housing in a downward direction, wherein the feeding of hydraulic fluid to the lower portion of the cylinder housing results in contraction of the multi-cylinder system; and wherein the upper end of the rod system is attached to the piston rod of the lowest cylinder of the multi-cylinder system.

19. The method of claim 9, wherein at least one pneumatic cylinder being capable of storing gravitational and excess hydraulic energy is affixed to at least one of the cylinders of the multi-cylinder system.

20. The method of claim 19, wherein said at least one of said pneumatic cylinders stores energy by compressing a gas located in one of the cavities of said pneumatic cylinder, said pneumatic cylinder storing energy by enlarging a partial vacuum in another of the cavities thereof.

21. A hydraulic pumping unit, capable of driving a downhole pump in a well, such that well-fluid will be brought to the surface of the well, comprising:

(a) a frame;

(b) a plurality of hydraulic cylinders, each cylinder comprising, (1) a cylinder housing, (2) a piston slidably mounted within said cylinder housing, and being capable of moving up and down within said cylinder housing, wherein said piston has an upper and lower face, (3) a piston rod fixed at one end to one of the faces of said piston, with the other end of the piston rod protruding from one of the ends of said cylinder housing, (4) port means capable of permitting the flow of fluid into and out of the cylinder housing;

(c) intermediate connection means for connecting the piston rod of one cylinder to the end of another cylinder located immediately adjacent said one cylinder, said intermediate connection means being positioned between said plurality of cylinders such that all of the cylinders are linearly connected and a multi-cylinder system is provided;

(d) upper connecting means for suspending and gravity centering said multi-cylinder system, said upper connecting means being connected to a point at the top of said frame and being connected to either the piston rod or the cylinder housing of the top hydraulic cylinder of the multi-cylinder system;

(e) lower connecting means connected at one end to the end of the lowest cylinder of said multi-cylinder system, and the other end of the lower connecting means being connectable to a rod located below the lowest cylinder, such that the rod can be reciprocated up and down by expansion and contraction of said multi-cylinder system;

the upper portion of each cylinder housing together with the upper face of each piston located within each cylinder housing defining an upper cavity for the flow of fluid, such that each piston is urged downwardly relative to the cylinder housing in which it is located when fluid is fed into the upper cavity;

and the lower portion of each cylinder housing together with the lower face of each piston located within each cylinder housing defining a lower cavity, such that each piston is urged upwardly relative to the cylinder housing in which it is located when fluid is fed into the lower cavity.

22. Apparatus for pumping oil from a well comprising:

(1) the hydraulic pumping unit of claim 21;

(2) a connection system containing at least one rod, the upper end of the connection system being connected to said lower connecting means; and (3) a subsurface fluid pump having a traveling portion, which traveling portion is connected to the lower end of the connection system;

wherein the traveling portion of the pump is reciprocated up as the multi-cylinder unit is contracted and down as the multi-cylinder unit is expanded.

23. The pumping unit of claim 21, including means for controlling the piston stroke phasing of the cylinders in the multi-cylinder system, such that the piston stroke of each cylinder terminates sequentially and slightly out of phase with the stroke termination of the next adjacent cylinder to provide a smooth and dampened reciprocating action to a rod connected to said lower connection means.

24. The pumping unit of claim 21, wherein the multi-cylinder system includes means for controlling the piston stroke phasing of the cylinders, such that there is at least one leading cylinder and at least one trailing cylinder, the leading cylinder being controlled to begin a reversal of stroke direction just as the trailing cylinder is completing a stroke.

25. The hydraulic pumping unit of claim 21, including means for sensing conditions in the downhole of a well, and control means responsive to said means for sensing, said control means being capable of regulating the action of the cylinders of the multi-cylinder system, in response to said sensing means.

26. The hydraulic pumping unit of claim 21, including means for controlling the direction of fluid flow to and from the cylinders in order to regulate the stroke length of each cylinder and provide desired stroke length smoothness of pumping and stroke speed of the overall multi-cylinder stroke during different stages of the overall stroke.

27. The hydraulic pumping unit of claim 21, including means for controlling the amount of fluid which enters each cylinder and the volumetric flow rate of entry.

28. The hydraulic pumping unit of claim 21, including means to rigidly affix the multi-cylinder system to said frame after the multi-cylinder system has been gravity centered, such that the multi-cylinder system rigidly reciprocates up and down.

29. The pumping unit of claim 21, wherein at least one of the cylinders of the multi-cylinder unit is a double acting cylinder, and wherein said port means includes one port permitting the flow of fluid to said upper cavity and another port permitting the flow of fluid to said lower cavity, and further including means for feeding fluid to the upper cavity and means for feeding fluid to the lower cavity.

30. The pumping unit of claim 21, wherein said port means includes a port on the piston rod end of each cylinder, and a port on the non-piston rod end of each cylinder; and wherein the port on the piston rod end of each cylinder is connected to a means for feeding hydraulic fluid to each cylinder, and the port on the non-piston rod end is vented to the atmosphere.

31. The hydraulic pumping unit of claim 21, wherein said port means includes a port in fluid communication with the piston rod end of each cylinder of said multi-cylinder unit, and a cavity in said non-piston rod end of each cylinder for containing a compressible gas.

32. The hydraulic pumping unit of claim 21, including at least one pneumatic cylinder attached laterally to at least one of the hydraulic cylinders of the multi-cylinder unit;

said pneumatic cylinder including means for compressing a compressible gas upon expansion of said multi-cylinder unit, and means for creating a partial vacuum as said multi-cylinder unit is expanded.

33. The hydraulic pumping unit of claim 21, including at least one pneumatic cylinder attached to at least one of the hydraulic cylinders of the multi-cylinder system;

said pneumatic cylinder including means for storing the downstroke gravitational energy and excess energy of a hydraulic pump feeding fluid to the multi-cylinder system.

34. The hydraulic pumping unit of claim 21, wherein the piston rod protrudes from the upper end of each cylinder housing of the multi-cylinder system;

said intermediate connection means connect the piston rod of one cylinder in the system to the end of another cylinder located immediately above said one cylinder;

said upper connecting means for suspending and gravity centering said multi-cylinder system being connected to a point at the top of said frame and to the piston rod of the top cylinder of the multi-cylinder system; and said lower connecting means being connected to the lower end of the lowest cylinder of said multi-cylinder system.

35. The hydraulic pumping unit of claim 21, wherein the piston rod protrudes from the lower end of each cylinder of the multi-cylinder housing system;

said intermediate connection means connects the piston rod of one cylinder in the system to the end of another cylinder located immediately below said one cylinder;

said upper connecting means for suspending and gravity centering said multi-cylinder system being connected to a point at the top of said frame and to the upper end of the top cylinder of the multi-cylinder system; and said lower connecting means being connected to the piston rod of the lowest cylinder of said multi-cylinder system.

36. The hydraulic pumping unit of claim 21, including means for feeding hydraulic fluid to the cylinders of the multi-cylinder system.

37. The hydraulic pumping unit of claim 36, including means for accumulating, under pressure, hydraulic fluid exiting from the cylinders of the multi-cylinder unit, and means for accumulating, under pressure, the fluid being fed to the cylinders of the multi-cylinder unit.

38. The hydraulic pumping unit of claim 21, including a plurality of separate means for regulating and feeding fluid to the cylinders of said multi-cylinder system.

39. The hydraulic pumping unit of claim 38, wherein each separate means for regulating and feeding fluid to said cylinders feeds a separate cylinder of said multi-cylinder system.

40. The hydraulic pumping unit of claim 21, including:

means for feeding hydraulic fluid to said multi-cylinder system;

means for permitting discharge of the fluid from the multi-cylinder system;

means for cooling said fluid after it has been discharged from said multi-cylinder system; and means for returning said fluid to said means for feeding, after said fluid has been cooled.

41. The hydraulic pumping unit of claim 40, including means for feeding cool well effluent to said means for cooling;

said means for cooling including means for bringing said fluid in thermal contact with said cool well effluent.

* * * * *